US010703096B2

(12) United States Patent
Otsuka et al.

(10) Patent No.: US 10,703,096 B2
(45) Date of Patent: Jul. 7, 2020

(54) DETECTING DEVICE, DROPLET DISCHARGING DEVICE, AND DETECTING METHOD

(71) Applicant: SEIKO EPSON CORPORATION, Tokyo (JP)

(72) Inventors: Shuji Otsuka, Shiojiri (JP); Seiichi Taniguchi, Higashichikuma-gun (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/243,736

(22) Filed: Jan. 9, 2019

(65) Prior Publication Data

US 2019/0217606 A1 Jul. 18, 2019

(30) Foreign Application Priority Data

Jan. 12, 2018 (JP) ..... 2018-003018

(51) Int. Cl.
*B41J 2/045* (2006.01)
*B41J 2/165* (2006.01)
*B41J 2/21* (2006.01)

(52) U.S. Cl.
CPC ..... *B41J 2/0456* (2013.01); *B41J 2/0451* (2013.01); *B41J 2/04558* (2013.01); *B41J 2/04586* (2013.01); *B41J 2/16579* (2013.01); *B41J 2/2142* (2013.01)

(58) Field of Classification Search
CPC .. B41J 2/0456; B41J 2/04586; B41J 2/04558; B41J 2/0451
See application file for complete search history.

(56) References Cited

U.S. PATENT DOCUMENTS

2004/0141209 A1 7/2004 Marumoto et al.
2007/0040884 A1* 2/2007 Shoki ..... B41J 2/04508 347/101

FOREIGN PATENT DOCUMENTS

JP 2004-237725 A 8/2004

* cited by examiner

*Primary Examiner* — Sharon A. Polk
(74) *Attorney, Agent, or Firm* — Foley & Lardner LLP

(57) ABSTRACT

A detecting device is configured to detect a discharge state of droplets from a discharging head configured to discharge droplets onto a medium. A detecting device includes an irradiation unit configured to irradiate the medium on which a predetermined pattern is recorded with the droplets with irradiation light, and to scan the medium with the irradiation light in a scanning direction, a light-receiving unit configured to receive reflected light which is the irradiation light reflected by the medium, and to output a signal indicating intensity of the reflected light, and a control unit configured to perform determination process for determining a discharge state of the droplets onto the medium by using intensity change of the reflected light in scanning the predetermined pattern in the scanning direction.

8 Claims, 11 Drawing Sheets

DETECTING DEVICE, DROPLET DISCHARGING DEVICE, AND DETECTING METHOD

BACKGROUND

1. Technical Field

The invention relates to a detecting device, a droplet discharging device, and a detecting method.

2. Related Art

As one mode of a droplet discharging device, there has been known an ink jet-type printer (hereinafter, also simply referred to as "printer") for discharging droplets of ink from a discharging head. In some cases, the printer has a function as a detecting device for detecting a discharge state of droplets by optically reading a test pattern, which is formed on a medium through discharge of droplets from the discharging head (for example, JP-A-2004-237725 described below).

In the technique in JP-A-2004-237725 mentioned above, after the test pattern is read at low resolution to specify a target location to be corrected, the vicinity of the target location to be corrected is measured at high resolution. In the technique in JP-A-2004-237725, in addition to the examination of the test pattern at low resolution, the examination of the test pattern at high resolution is performed. Accordingly, the number of examinations of the test pattern is disadvantageously increased. Further, it is required to use an optical sensor with high resolution so as to read the test pattern.

However, it is desired that such detection of a discharge state of droplets be improved so that the detection can be performed more easily with a simpler configuration. Such issue is common not only to a printer, but also to a detecting device and a detecting method for detecting a discharge state of droplets from a discharging head, and to a droplet discharging device for discharging droplets from a discharging head onto a medium.

SUMMARY

The invention has been made to address at least some of the above-described issues and can be realized as the following embodiments.

[1] According to a first aspect of the invention, a detecting device for detecting a discharge state of droplets from a discharging head configured to discharge the droplets onto a medium is provided. A detecting device of this aspect includes an irradiation unit configured to irradiate the medium on which a predetermined pattern is recorded with the droplets with irradiation light, and to scan the medium with the irradiation light in a scanning direction, a light-receiving unit configured to receive reflected light which is the irradiation light reflected by the medium, and to output a signal indicating intensity of the reflected light, and a control unit configured to perform determination process for determining the discharge state of the droplets onto the medium by using intensity change of the reflected light in scanning the predetermined pattern in the scanning direction.

According to the detecting device of this aspect, the discharge state of the droplets is determined with the intensity change of the reflected light depending on the pattern. Thus, the discharge state of the droplets can be examined without reading the pattern with a high resolution and high definition. Therefore, the configuration of the detecting device can be simplified.

[2] In the detecting device according to the above-mentioned aspect, the predetermined pattern may be configured by an arrangement of dots formed of the droplets, and the light-receiving unit includes an opening defining a visual field in which a predetermined number of the dots included in the predetermined pattern are to be included.

According to the detecting device of this aspect, a read range of the pattern can appropriately be defined. Thus, the detection accuracy of the discharge state of the droplets can be improved.

[3] In the detecting device according to the above-mentioned aspect, the opening may include a part with a width from twice to twenty times as large as a diameter of each of the dots.

According to the detecting device of this aspect, the visual field of the light-receiving unit is defined appropriately for a size of the dots forming the pattern. Thus, the detection accuracy of the discharge state of the droplets can be improved.

[4] In the detecting device according to the above-mentioned aspect, the light-receiving unit may include an optical sensor having a lower resolution than a printing resolution of the discharging head.

According to the detecting device of this aspect, the light-receiving unit can be formed of an optical sensor with a low resolution. Thus, the configuration of the detecting device can be simplified, and the manufacturing cost of the detecting device can be reduced.

[5] In the detecting device according to the above-mentioned aspect, the predetermined pattern may include at least a dot row in which a plurality of dots are arranged, and the control unit may be configured to detect whether landing positions of the droplets are shifted in the scanning direction by using a period of intensity change of the reflected light which is obtained by scanning the dot row in the scanning direction.

According to the detecting device of this aspect, a shift in the positional relationship between the dots forming the dot row is detected as a shift of the period of the intensity change of the reflected light. Therefore, it is easily detected that the landing positions of the droplets are shifted.

[6] In the detecting device according to the above-mentioned aspect, the predetermined pattern may include an overlapping dot row being a dot pattern in which a plurality of dots are arranged in a partially overlapping state, and the control unit may be configured to detect whether landing positions of the droplets are shifted by using intensity of the reflected light which is obtained by scanning the overlapping dot row in the scanning direction.

According to the detecting device of this aspect, a change of the area of the dots in the pattern, which is caused by a shift in the positional relationship between the dos forming the overlapping dot row is detected as a change of the magnitude of the intensity of the reflected light. Therefore, it is easily detected that the landing positions of the droplets are shifted.

[7] In the detecting device according to the above-mentioned aspect, the light-receiving unit may include the opening and a mask member to be attached to a path for taking in the reflected light.

According to the detecting device of this aspect, the visual field of the light-receiving unit can easily be defined with the mask member.

[8] According to a second aspect of the invention, a droplet discharging device is provided. The droplet discharging device according to this aspect includes a discharging head configured to discharge droplets onto a medium, and the detecting device according to any of the above-mentioned aspects.

According to the droplet discharging device of this aspect, the detecting device can easily detect a discharge state of droplets from the discharging head.

[9] The droplet discharging device according to above-mentioned aspect may further include a transport path configured to transport the medium. The discharging head may be configured to move in a moving direction orthogonal to a transport direction of the medium on the transport path, the irradiation unit and the light-receiving unit may be positioned on a downstream side with respect to the discharging head on the transport path, and a pattern formation process for forming the predetermined pattern on the medium may be performed, the predetermined pattern in which dot patterns with a plurality of dots are arranged in a direction orthogonal to the transport direction being arranged in a direction obliquely crossing the transport direction, the predetermined pattern being formed by the discharging head moving in the moving direction and discharging the droplets while the medium is transported on the transport path in the transport direction, and the determination process may be performed by scanning the predetermined pattern in a direction opposite to the transport direction as the scanning direction.

According to the droplet discharging device of this aspect, the pattern formation process and the determination process can be performed in parallel, which is efficient.

According to a third aspect of the invention, a detecting method for detecting a discharge state of droplets from a discharging head configured to discharge the droplets onto a medium is provided. The method according to this aspect includes scanning a predetermined pattern which is recorded on the medium with the droplets discharged from the discharging head, with irradiation light in a scanning direction, receiving reflected light which is the irradiation light reflected by the medium, and acquiring a signal indicating intensity change of the reflected light, and determining the discharge state of the droplets onto the medium by using the signal.

According to the method of this aspect, the discharge state of the droplets can easily be determined by the intensity change of the reflected light depending on the pattern.

All of the plurality of components included in each of the above-described aspects of the invention are not necessary, and in order to solve some or all of the above-described issues, or in order to achieve some or all of effects described in this specification, with respect to some of the plurality of components, it is possible to perform, as appropriate, change, deletion, replacement with other new components, or deletion of some of limited contents. In addition, in order to solve some or all of the above-described issues, or in order to achieve some or all of effects described in this specification, it is possible to combine some or all of technical features included in one of the above-described aspects of the invention with some or all of technical features included in another one of the above-described aspects of the invention to arrive at an independent aspect of the invention.

The invention can be achieved in various exemplary embodiments other than the detecting device, the droplet discharging device, and the detecting method. For example, the invention can be achieved in exemplary embodiments such as a control method for a detecting device and a droplet discharging device, a computer program for implementing a detecting method and a control method, and a non-transitory recording medium recording the computer program.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. First Exemplary Embodiment

Schematic Configuration of Droplet Discharging Device

Figure 1:
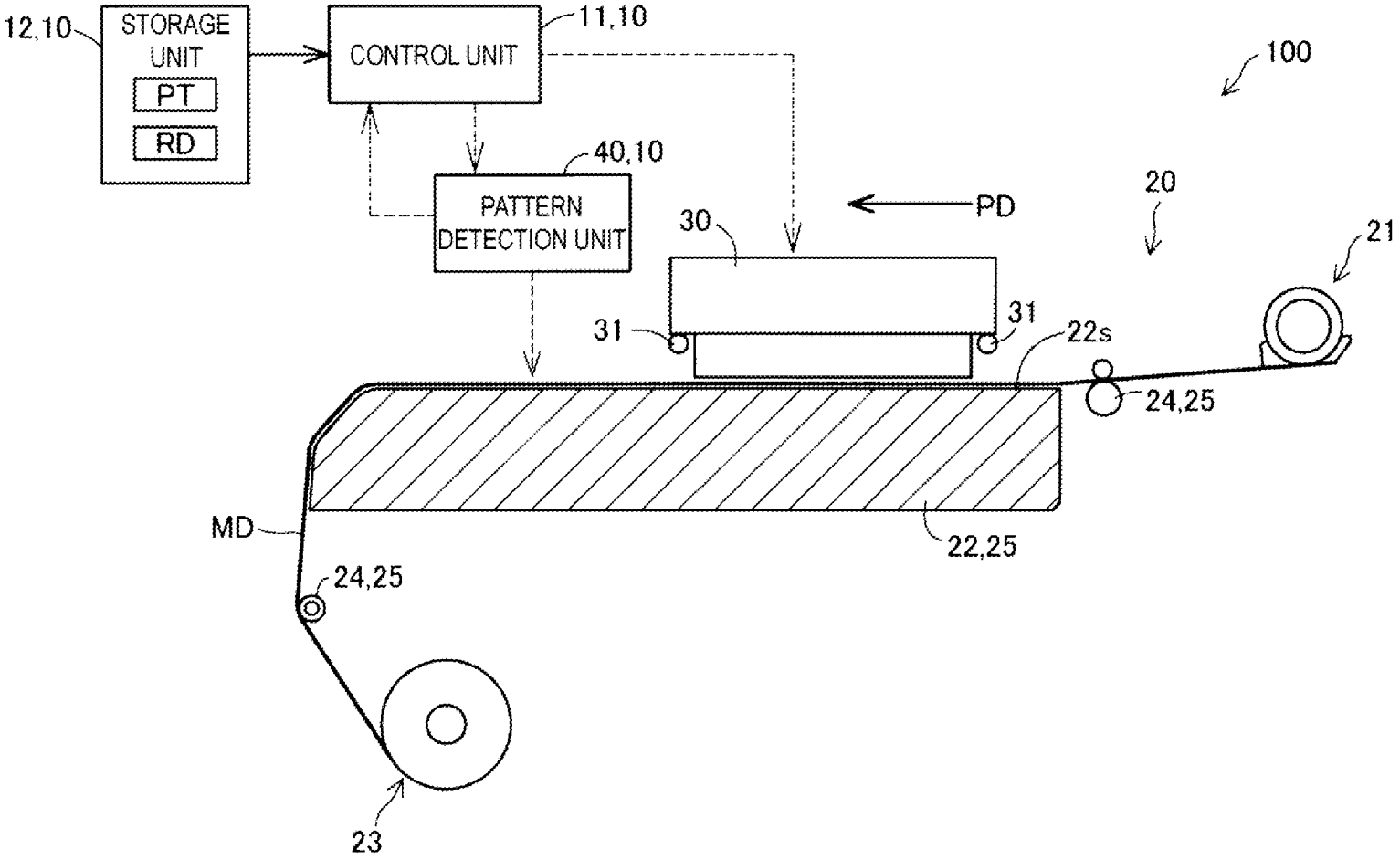
FIG. 1 is a schematic view illustrating a configuration of a droplet discharging device.

FIG. 1 is a schematic view illustrating a configuration of a droplet discharging device 100 including a detecting device 10 according to First Exemplary Embodiment. The droplet discharging device 100 is an ink jet-type printer configured to form an image by discharging droplets of ink and recording dots on a medium MD. In First Exemplary Embodiment, the medium MD is a printing sheet.

The droplet discharging device 100 includes a control unit 11, a storage unit 12, a transport unit 20, a discharging head 30, and a pattern detection unit 40. The droplet discharging device 100 further includes the detecting device 10 configured to detect a discharge state of droplets of the droplet discharging device 100. In First Exemplary Embodiment, the detecting device 10 is configured to be operable by the control unit 11, the storage unit 12, and the pattern detection unit 40. The detecting device 10 is described in detail later.

The control unit 11 is a microcomputer including a Central Processing Unit (CPU) and a Random Access Memory (RAM). The CPU reads various commands and programs in the RAM for execution, and thus the control unit 11 exerts various functions. In First Exemplary Embodiment, the control unit 11 has a function as a higher-layer control unit for controlling the entire droplet discharging device 100 and a function as a lower-layer control unit for controlling the detecting device 10.

As the control unit for the droplet discharging device 100, the control unit 11 is configure to perform a printing process by controlling discharge of droplets from the discharging head 30. The control unit 11 is configure to control, in the printing process, transport of the medium MD performed by the transport unit 20 and discharge of ink from the discharging head 30 according to printing data input from outside or an operation performed by a user, which is received through an operation unit (not illustrated) of the droplet discharging device 100.

As the control unit for the droplet discharging device 100, the control unit 11 is configured to perform a pattern formation process in which a predetermined pattern to be used by the detecting device 10 for an inspection process (to be described later) is recorded on the medium MD with droplets discharged from the discharging head 30. Further, as the control unit for the detecting device 10, the control unit 11 is configured to perform a determination process (to be described in detail later) for determining a discharge state of droplets from the discharging head 30 by causing the pattern detection unit 40 to scan the pattern formed in the pattern formation process.

The storage unit 12 is a non-volatile storage device. Pattern data PT indicating the pattern formed in the pattern formation process and reference data RD to be used in the determination process are prepared and stored in the storage unit 12.

The transport unit 20 is configured to transport the medium MD being a belt-shaped printing sheet in a longitudinal direction of the medium MD under control of the control unit 11. The transport unit 20 includes a feeding unit 21, a support base 22, a winding unit 23, and a plurality of transport rollers 24. In the droplet discharging device 100, a transport path 25 for the medium MD is formed of the support base 22 and the plurality of transport rollers 24. The feeding unit 21 is configured to feed the medium MD from a state of being wound in a roll shape. The medium MD fed from the feeding unit 21 is transported onto a base surface 22*s* of the support base 22 while being applied with tension by the transport rollers 24.

The medium MD is transported along the base surface 22*s* under a state of being in contact with the base surface 22*s* of the support base 22. In FIG. 1, a transport direction PD of the medium MD on the base surface 22*s* is indicated by an arrow. In First Exemplary Embodiment, an upper surface of the medium MD on a side opposite to the base surface 22*s* is a printing surface. Transport rollers (not illustrated) for auxiliarily transporting the medium MD may be provided to the support base 22.

The winding unit 23 is provided on a downstream side with respect to the support base 22, and is configured to wind the medium MD, which is transported from the base surface 22*s*, in a roll shape with a rotating drive force of a motor (not illustrated). The medium MD is applied with tension by the transport rollers 24 between the winding unit 23 and the support base 22. The control unit 11 is configured to control a rotational drive of the motor of the winding unit 23 to control transport of the medium MD on the base surface 22*s*.

The discharging head 30 is provided to be capable of facing the printing surface of the medium MD to be transported on the base surface 22*s* of the support base 22. The discharging head 30 includes a plurality of nozzles (to be described later), which are opened to the base surface 22*s* of the support base 22. The discharging head 30 is configured to discharge droplets of ink from each nozzle to record dots on the printing surface of the medium MD under control of the control unit 11.

The discharging head 30 is supported by rails 31 laid in a direction parallel to the base surface 22*s* and a direction crossing the transport direction PD. The discharging head 30 is coupled to a drive belt (not illustrated), and is configured to move along the rails 31 in the direction crossing the transport direction PD with a driving force of a motor (not illustrated) transmitted by a pulley under control of the control unit 11. In First Exemplary Embodiment, the rails 31 are laid in the direction crossing the transport direction PD, and the discharging head 30 is configured to move the direction crossing the transport direction PD.

Figure 2:
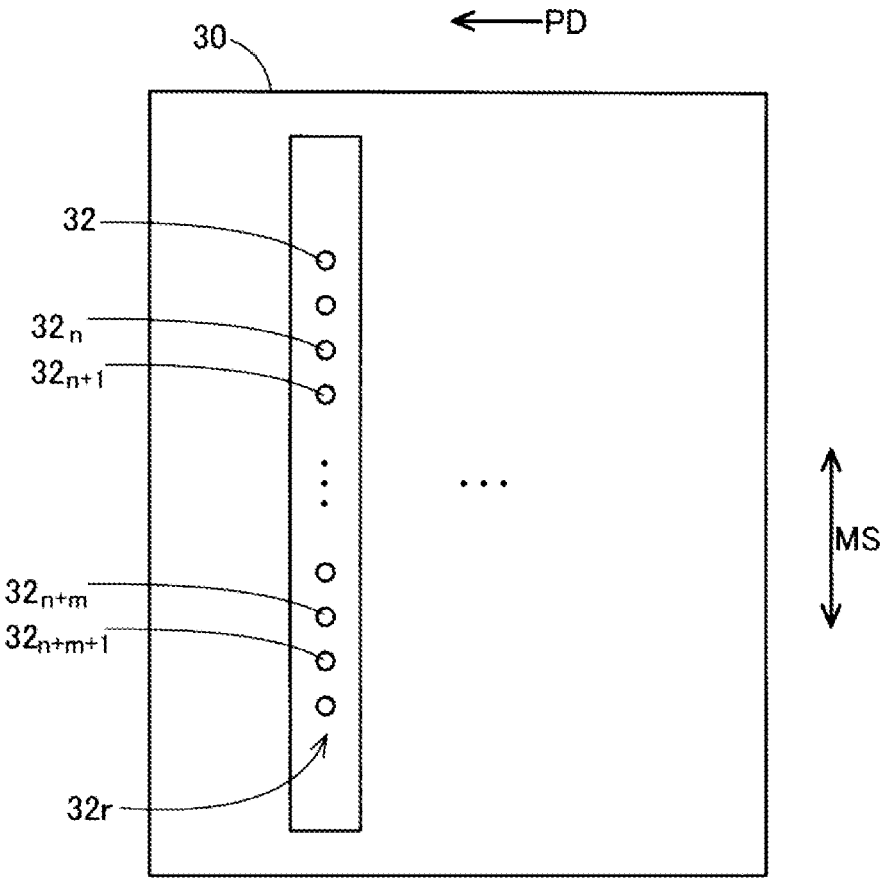
FIG. 2 is a schematic view illustrating an example of an arrangement structure of nozzles of a discharging head.

FIG. 2 is a schematic view illustrating an example of an arrangement structure of nozzles 32 of the discharging head 30. In FIG. 2, a lower surface of the discharging head 30, which faces the printing surface of the medium MD, is schematically illustrated. Further, in FIG. 2, the arrow indicating the transport direction PD of the medium MD in the droplet discharging device 100 and an arrow indicating a moving direction MS of the discharging head 30 are illustrated.

The discharging head 30 includes the plurality of nozzles 32. In the discharging head 30, the nozzles 32 form a nozzle row 32*r* in which the N nozzles 32 (N is an arbitrary natural number equal to or larger than two) are arranged along the moving direction MS. In First Exemplary Embodiment, the nozzles 32 are linearly arranged along the moving direction MS. The nozzles 32 may be arranged in a staggered manner, that is, in a zig-zag form along the moving direction MS. In the discharging head 30, one or more nozzle rows 32*r* may be arranged in parallel with each other in the transport direction PD. When the plurality of nozzle rows 32*r* are included, each nozzle row 32*r* may discharge ink of a different color.

Configuration of Detecting Device

Figure 3:
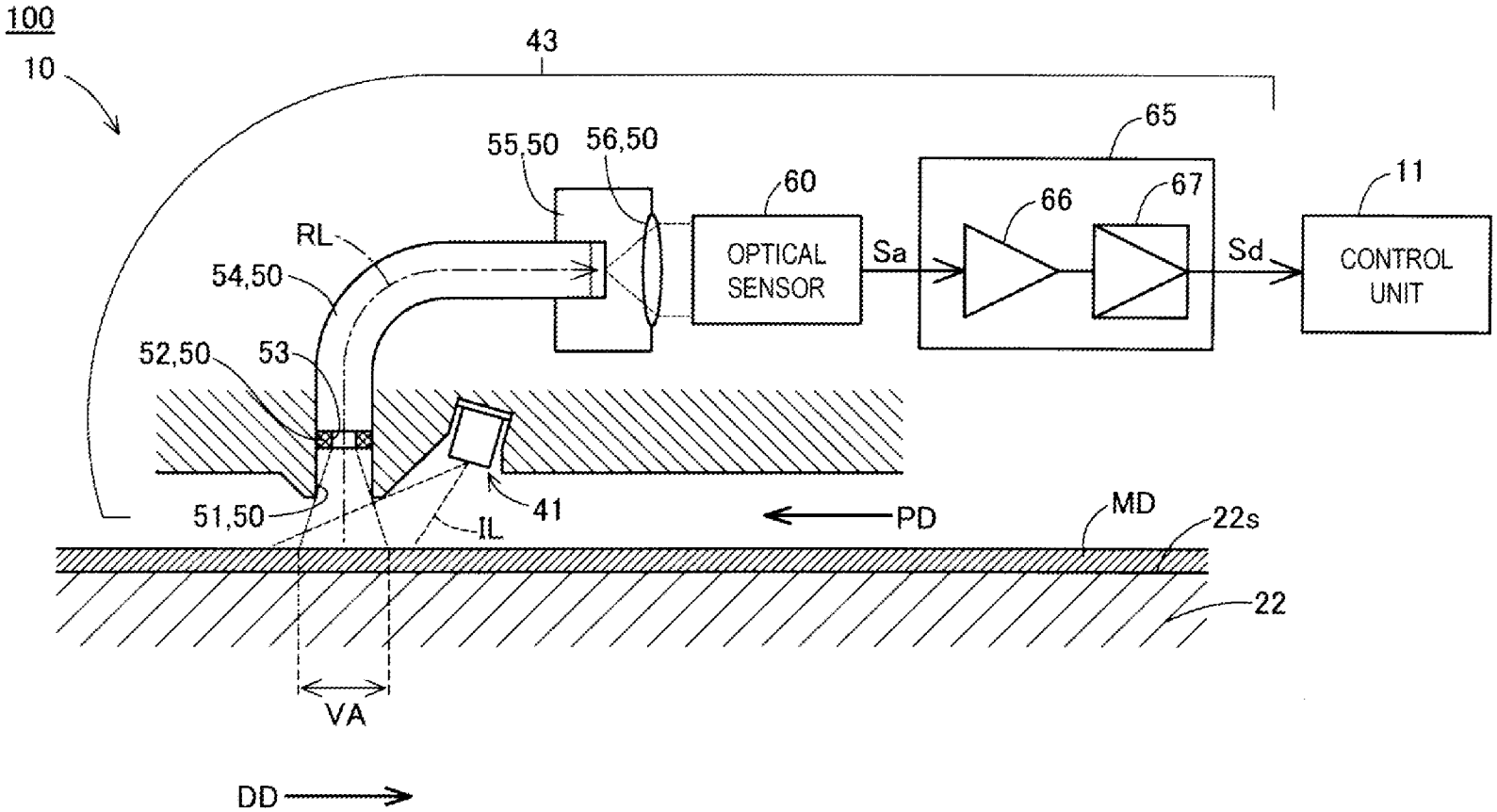
FIG. 3 is a schematic view illustrating a configuration of a detecting device.

FIG. 3 is a schematic view illustrating a configuration of the detecting device 10 according to First Exemplary Embodiment. The pattern detection unit 40 of the detecting device 10 is configured to scan the medium MD on the support base 22 forming the transport path 25 for the medium MD on a downstream side with respect to the discharging head 30 (FIG. 1). The pattern detection unit 40 includes an irradiation unit 41 and a light-receiving unit 43.

The irradiation unit 41 is configured to emit non-coherent irradiation light IL from above the base surface 22*s* toward the printing surface of the medium MD under control of the control unit 11. The irradiation light IL may have a wavelength of an infrared ray region. The irradiation light IL is generated by, for example, light emitting elements such as LED. In First Exemplary Embodiment, an optical axis of the irradiation unit 41 is inclined with respect to the base surface 22*s*. When the medium MD is transported by the transport unit 20 in the transport direction PD, the irradiation unit 41 is moved relative to the medium MD, and the medium MD is thus scanned with the irradiation light IL in a scanning direction DD opposite to the transport direction PD.

The light-receiving unit 43 is configured to receive part of light diffused/reflected light RL (hereinafter, also simply referred to as "reflected light RL"), which is the irradiation light IL reflected by the medium MD, and output a signal indicating intensity of the reflected light RL. The light-receiving unit 43 includes a light-intake part 50, an optical sensor 60, and a light-receiving circuit 65.

The light-intake part 50 is configured to take in part of the reflected light RL above the base surface 22*s*, and guides the part of the reflected light RL to the optical sensor 60. The light-intake part 50 includes a light inlet 51, a mask member 52, an optical fiber 54, a connector part 55, and a lens 56. The light inlet 51 is arranged to be openable to the medium MD above the support base 22 so that the reflected light RL reflected by the medium MD can be taken in.

It is desired that surface treatment such as coating with a coating material having a high light-absorbing property is applied on an inner wall surface of the light inlet 51 to suppress reflection of the reflected light RL. Further, it is desired that the light inlet 51 is configured to project to the medium MD to suppress entry of the irradiation light IL or external light into the light inlet 51. With this structure, noise is prevented from being mixed in a signal output to the light-receiving unit 43 due to interference of excessive light.

The mask member 52 is attached at a deep position in the light inlet 51 being a path for taking in the reflected light RL. The mask member 52 includes an opening 53 defining a visual field VA of the light-receiving unit 43. The visual field VA is defined by a shape and a size of the opening 53 and a distance between the opening 53 and the medium MD. It is desired that the opening 53 have a rectangular shape. In First Exemplary Embodiment, the opening 53 has a square shape.

The opening 53 of the mask member 52 is connected to an end surface of the optical fiber 54. The end surface of the optical fiber 54 is closed with the mask member 52 except for a region to which the opening 53 is connected. The reflected light RL passing through the opening 53 of the mask member 52 is guided into the optical fiber 54.

Another end of the optical fiber 54 on an outlet side is connected to the connector part 55. The connector part 55 is formed of a resin-made member. The connector part 55 is configured to guide all the reflected light RL to be emitted from the optical fiber 54 to the lens 56. The lens 56 is attached to be fixed to the connector part 55, and is configured to concentrate the reflected light RL entering the lens 56 itself to a light-receiving surface of the optical sensor 60.

The optical sensor 60 is formed of, for example, a photosensor such as a photodiode. The optical sensor 60 is configured to receive light on the light-receiving surface, and then output a light-receiving signal Sa being an analog electric signal indicating intensity of the received light. The light-receiving signal Sa is input to the light-receiving circuit 65. Note that, as the optical sensor 60, an optical sensor having a resolution lower than a printing resolution of the discharging head 30 may be employed. Here, "printing resolution" indicates an interval between adjacent nozzles 32 arranged in the nozzle row 32*r* included in the discharging head 30. In a case where the discharging head 30 and the medium MD face with each other and where droplets discharged from the nozzles 32 adjacent to each other reach the medium MD without causing a discharge curve so that dots are formed, an interval between centers of the adjacent dots is substantially equal to the interval between the nozzles 32 adjacent to each other. Thus, the printing resolution of the discharging head 30 can be understood as a dot formation resolution in an ideal state. Further, "resolution of the optical sensor 60" indicates resolving power of the optical sensor 60. In a case where droplets are discharged from the nozzles 32 of the discharging head 30 and where a plurality of dots formed away from each other are failed to be individually detected by the optical sensor 60, it can be understood that the optical sensor 60 has a lower resolution than the printing resolution of the discharging head 30. Note that, even in a case where the optical sensor 60 is configured to detect a light amount of an entire detection range and the like, but does not include configuration, e.g., not including an imaging element, for detecting a shape of dots, a dot pattern, and the like in the detection range, such configuration is included in the configuration of "having a lower resolution than the printing resolution".

The light-receiving circuit 65 includes an amplifier 66 and an AD converter 67. The amplifier 66 is configured to amplify the light-receiving signal Sa output from the optical sensor 60 to be a signal within an input range of the AD converter 67. The AD converter 67 is configured to quantize the light-receiving signal Sa being an analog signal sequentially for a predetermined sampling period based on a sampling signal supplied from the control unit 11, to convert the light-receiving signal Sa to a light-receiving signal Sd being a digital signal for the sampling period, and outputs the light-receiving signal Sd to the control unit 11.

Note that, it is desired that the opening 53 of the mask member 52 have a width from twice to twenty times as large as a diameter of dots DT forming a pattern PP (illustrated in FIG. 5 referred to later). When the opening 53 has a width twice or more times as large as the diameter of the dots, the light-receiving unit 43 is capable of reading the plurality of dots DT at one time. Further, when the opening 53 has a width twenty or less times as large as the diameter of the dots DT, the optical sensor 60 can be prevented from being excessively increased in size.

Figure 4:
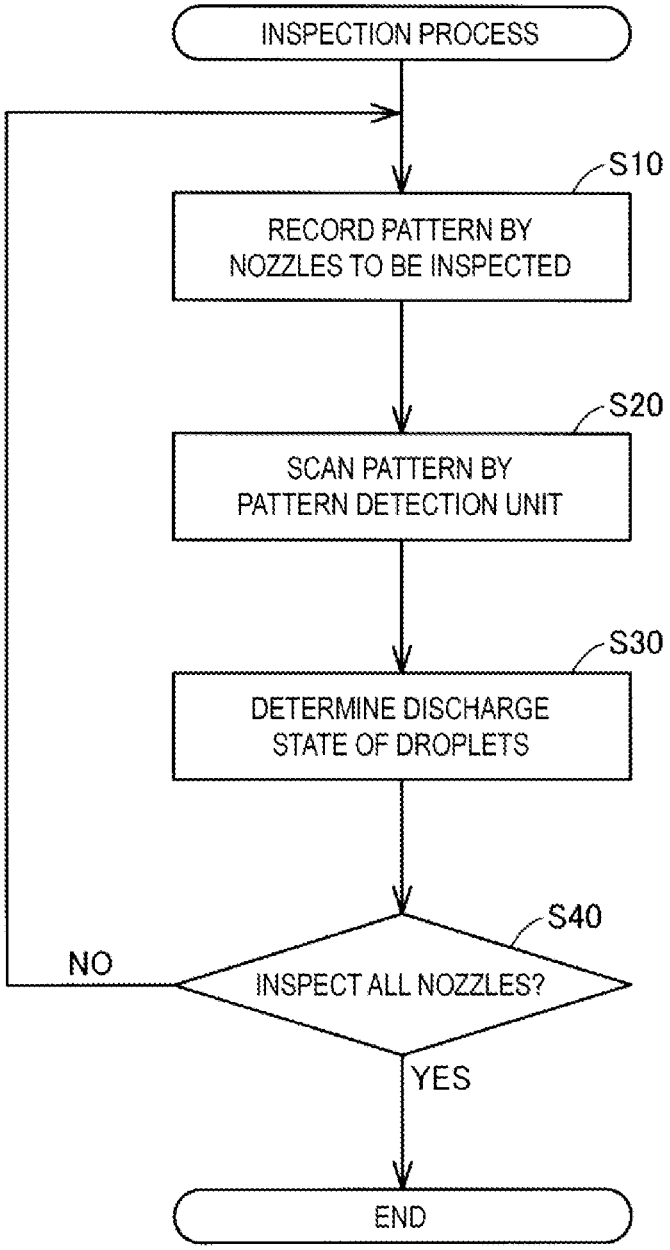
FIG. 4 is an explanatory view illustrating a flow of an inspection process for inspecting a discharge state of droplets.

FIG. 4 is an explanatory view illustrating a flow of the inspection process, which is performed in the droplet discharging device 100, for inspecting a discharge state of the droplets from the discharging head 30. In Step S10, the control unit 11 reads the pattern data PT from the storage unit 12 (FIG. 1). The control unit 11 controls the transport unit 20 and the discharging head 30, based on the pattern data PT, and causes the nozzles 32 to be inspected to discharge droplets to the medium MD, to record the pattern PP on the medium MD, the pattern PP being to be read by the detecting device 10.

Figure 5:
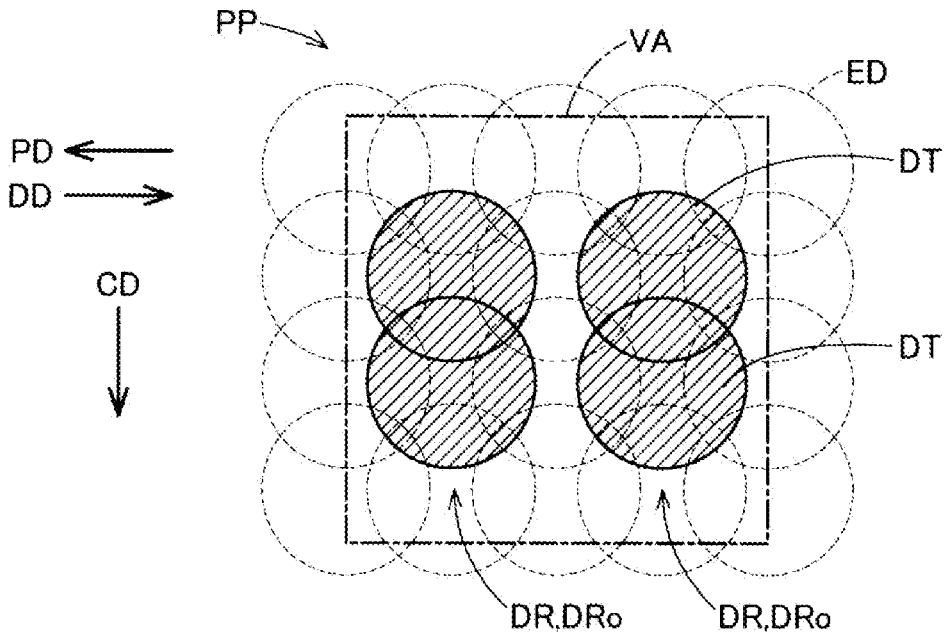
FIG. 5 is a schematic view illustrating an example of a pattern.

FIG. 5 is a schematic view illustrating an example of the pattern PP. In FIG. 5, the plurality of dots DT are schematically illustrated. The plurality of dots DT are recorded on the medium MD with droplets discharged from the discharging head 30, and form the pattern PP. Note that, empty dot regions ED are indicated with broken lines around the dots DT. In the empty dot regions ED, dots are recorded when a solid pattern is printed. Further, in FIG. 5, the visual field VA (FIG. 3) of the light-receiving unit 43 scanning the pattern PP is indicated with an alternate long and short dashed line.

In Step S10 (FIG. 4), arbitrary two nozzles $\mathbf{32}_n$ and $\mathbf{32}_{n+1}$ (FIG. 2) adjacent to each other among the N nozzles 32 in the nozzle row 32*r* are inspection targets. Suffixes including "n" in a symbol indicate an order of the nozzles 32 in an arrangement direction of the nozzle row 32*r*. Now, the nozzles $\mathbf{32}_n$ and $\mathbf{32}_{n+1}$ are also referred to as "target nozzles $\mathbf{32}_n$ and $\mathbf{32}_{n+1}$ to be inspected". The target nozzles $\mathbf{32}_n$ and $\mathbf{32}_{n+1}$ to be inspected may be designated by a user, or may be predetermined when the inspection process is started. The target nozzles $\mathbf{32}_n$ and $\mathbf{32}_{n+1}$ to be inspected may be allocated with a number sequentially from n=1.

The control unit 11 causes the discharging head 30 to move in the moving direction MS (FIG. 2) so that the target nozzles $\mathbf{32}_n$ and $\mathbf{32}_{n+1}$ to be inspected are positioned in the visual field VA when viewed along the transport direction PD. The control unit 11 causes the target nozzles $\mathbf{32}_n$ and $\mathbf{32}_{n+1}$ to be inspected to discharge droplets, and forms a dot row DR (FIG. 5) being a dot pattern in which the dots DT are arranged in a crossing direction CD crossing the transport direction PD. The crossing direction CD is an arrangement direction of the target nozzles $32_n$ and $32_{n+1}$ to be inspected. In First Exemplary Embodiment, the crossing direction CD is a direction orthogonal to the transport direction PD. In First Exemplary Embodiment, the dots DT forming the dot row DR are formed to have a size overlapping with each other. In other words, the dots DT are formed to have a size so that the diameter of the dots DT is larger than an arrangement interval of the nozzles 32. Now, the dot row DR is also referred to as "overlapping dot row DRo".

The control unit 11 causes the medium MD to move in the transport direction PD, and forms, at a position away from the overlapping dot row DRo that is formed in advance, another overlapping dot row DRo by the target nozzles $32_n$ and $32_{n+1}$ to be inspected. In an example in FIG. 5, another overlapping dot row DRo is formed at a position away by one dot in the transport direction PD.

In First Exemplary Embodiment, the pattern PP is formed by arrangement of the dots DT, and includes two overlapping dot rows DRo. The visual field VA of the light-receiving unit 43 is defined by the opening 53 of the mask member 52 so as to take in the reflected light RL from the predetermined number (four in the example in FIG. 5) of dots DT forming the pattern PP.

In Step S20 (FIG. 4), the control unit 11 scans the pattern PP (FIG. 5) with the pattern detection unit 40. The control unit 11 causes the medium MD to be transported in the transport direction PD, and causes the irradiation unit 41 to irradiate the pattern PP with the irradiation light IL. The control unit 11 thus allows the optical sensor 60 to receive the reflected light RL, and acquires the light-receiving signal Sd output from the AD converter 67 (FIG. 3).

The light-receiving signal Sd acquired by the control unit 11 in Step S20 indicates a change of the intensity of the reflected light RL while the pattern PP is scanned in the scanning direction DD. In Step S30, the control unit 11 uses the light-receiving signal Sd to perform the determination process for determining a discharge state of droplets.

Figure 6A:
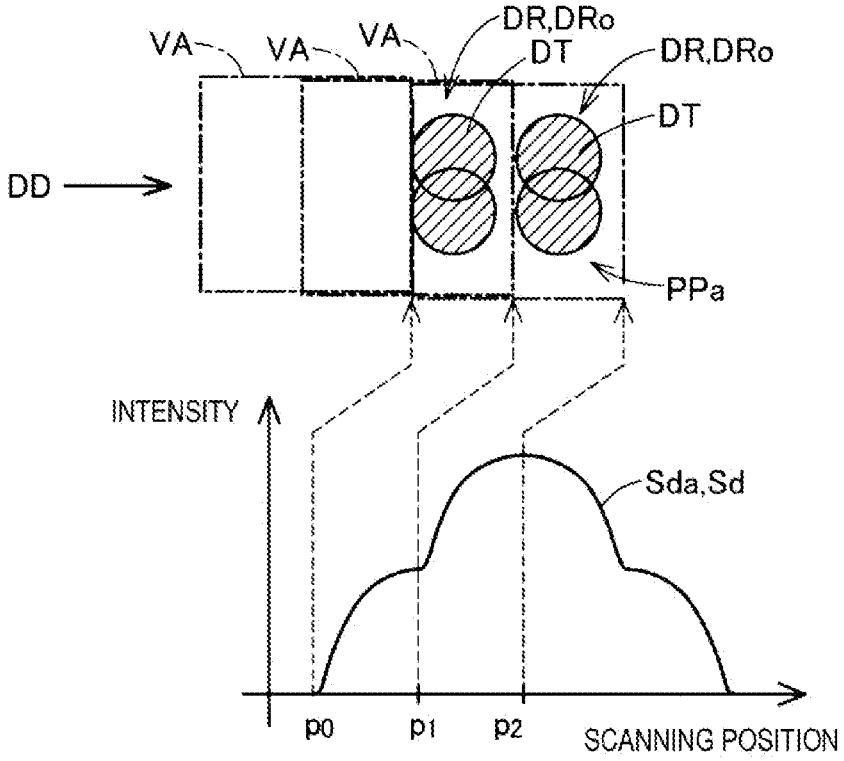
FIG. 6A is a schematic view illustrating an example of a scanning result of a pattern in a satisfactory discharge state of droplets.
Figure 6B:
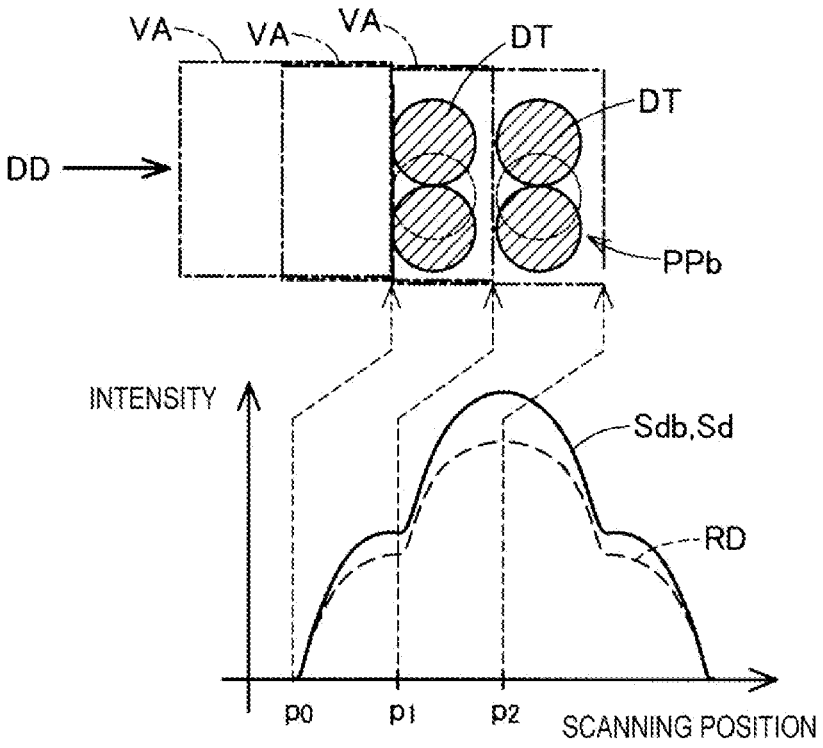
FIG. 6B is a schematic view illustrating an example of a scanning result of a pattern in which landing positions of droplets are shifted in a crossing direction.
Figure 6C:
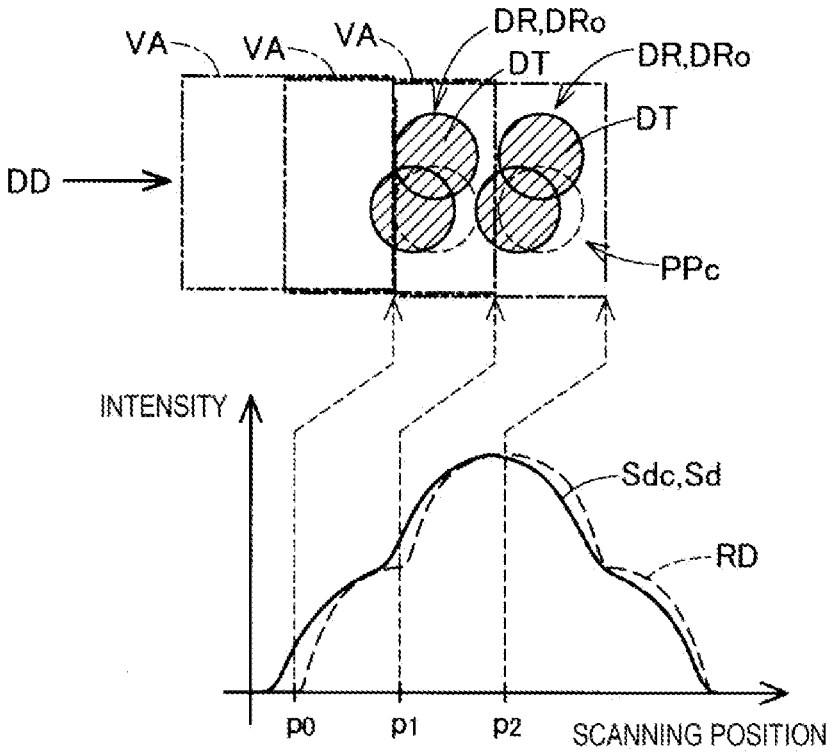
FIG. 6C is a schematic view illustrating an example of a scanning result of a pattern in which landing positions of droplets are shifted in a scanning direction.

With reference to FIG. 6A to FIG. 6C, the determination process performed by the control unit 11 is described. In upper parts in FIG. 6A to FIG. 6C, a pattern PPa to a pattern PPc formed under various discharge states of droplets are illustrated, respectively. Further, in lower parts, a light-receiving signal Sda to a light-receiving signal Sdc obtained by scanning the pattern PPa to the pattern PPc, respectively, are illustrated in graphs in which a vertical axis indicates the intensity of the reflected light RL and a horizontal axis indicates a scanning position of each of the pattern PPa to the pattern PPc. "Scanning position" indicates a position of the visual field VA with respect to the target pattern PP to be scanned. Note that, the intensity of the reflected light RL is illustrated to have a value reversed between positive and negative so as to have a larger value in a part in which the dots DT are formed.

FIG. 6A is a schematic view illustrating an example of a scanning result of the pattern PPa in a satisfactory discharge state of droplets. In this example, each of the dots DT forming the pattern PPa is recorded at a predetermined position with a predetermined size. When the pattern PPa is scanned, after a position p0, a first overlapping dot row DRo enters the visual field VA, and an area of the dots DT included in the visual field VA increases. Along with this, the intensity of the reflected light RL increases in a stepwise manner. Further, after a position p1, in addition to the first overlapping dot row DRo, a second overlapping dot row DRo enters the visual field VA, and the area of the dots DT in the visual field VA increases. Along with this, the intensity of the reflected light RL further increases in a stepwise manner. After a position p2, the two overlapping dot rows DRo are sequentially moved out from the visual field VA. Thus, the intensity of the reflected light RL decreases in a stepwise manner in contrast to the intensity from the position p0 to the position p2.

In the storage unit 12 (FIG. 1) is stored the reference data RD indicating a change of the intensity of the reflected light RL similar to the change in the light-receiving signal Sda. In the determination process, in a case where the light-receiving signal Sd obtained by scanning the pattern PP matches the reference data RD in a predetermined allowable range, the control unit 11 determines that a discharge state of droplets from the target nozzles $32_n$ and $32_{n+1}$ is normal.

FIG. 6B is a schematic view illustrating an example of a scanning result of the pattern PPb in which landing positions of droplets are shifted in the crossing direction CD. In this example, the dots DT to form the overlapping dot row DRo are shifted in a direction away from each other. When the pattern PPb is scanned, an area of the dots DT included in the visual field VA increases by an amount equivalent to a reduced overlapping area of the dots DT. Thus, the obtained intensity of the light-receiving signal Sdb increases as a whole as compared to the reference data RD. In contrast to the illustrated example, in a case where the dots DT to form the overlapping dot row DRo are shifted in a mutually approaching direction, the obtained intensity of the light-receiving signal Sdb decreases as a whole as compared to the reference data RD.

In a case where the shift amount of the intensity of the light-receiving signal Sd from the reference data RD is larger than a predetermined threshold value, the control unit 11 determines that landing positions of droplets are shifted in the crossing direction CD. At the time of determination, the control unit 11 may compare the maximum values of the intensities, or may compare average values of the intensities. As described above, through use of a magnitude of the intensity of the reflected light RL obtained by scanning the overlapping dot row DRo in the scanning direction DD, the control unit 11 detects a shift of landing positions of droplets in the crossing direction CD.

FIG. 6C is a schematic view illustrating an example of a scanning result of the pattern PPc in which landing positions of droplets are shifted in the crossing direction DD. In this example, the dots DT forming the overlapping dot row DRo are shifted in the scanning direction DD, and an arrangement direction of the dots DT is inclined as compared to the normal state. When the pattern PPc is scanned, a timing when one dot DT forming the overlapping dot row DRo enters the visual field VA or moves out from the visual field VA is changed from the timing of the normal state in which the dots DT are not shifted. Thus, a start timing of increase or decrease in the obtained intensity of the light-receiving signal Sdb is changed, and a period of an intensity change of the light-receiving signal Sdb is shifted from the reference data RD.

In a case where the shift amount of the period of the intensity change of the light-receiving signal Sd from the reference data RD is larger than a predetermined threshold value, the control unit 11 determines that landing positions of droplets are shifted in the crossing direction CD. At the time of determination, the control unit 11 may detect a shift of a timing when a rate of change of the intensity reaches a predetermined value as a shift of the period of the intensity change. Alternatively, the control unit 11 may detect a shift of a timing when the intensity reaches a predetermined intensity as a shift of the period of the intensity change. As described above, through use of the period of the intensity change of the reflected light RL obtained by scanning the overlapping dot row DRo in the scanning direction DD, the control unit 11 detects a shift of landing positions of droplets in the scanning direction DD. Note that, it may be detected in a similar way that landing positions of droplets are shifted in the scanning direction DD by scanning the dot row DR in which the dots DT do not overlap with each other.

The control unit 11 changes target nozzles $\mathbf{32}_n$ and $\mathbf{32}_{n+1}$ to be inspected, and repeats processes from Step S10 to Step S30 until all the nozzles 32 to be inspected are inspected (FIG. 4). In a case where it is detected that landing positions of droplets are shifted in the determination process in Step S30, the control unit 11 may perform a correction process for correcting a magnitude or a period of a driving signal for the discharging head 30 so as to eliminate the shift of the landing positions. Alternatively, the control unit 11 may perform a maintenance process for restoring the nozzles 32 to a normal state by, for example, wiping off foreign objects, which adhere to the vicinity of the nozzles 32 and change a flying direction of droplets. Further, the control unit 11 may inform a user of a determination result indicating that the discharging head 30 may be broken or degraded.

As described above, with the detecting device 10 according to First Exemplary Embodiment, a discharge state of droplets is determined by using a change of the intensity of the reflected light RL according to a change of an area of the dots DT included in the visual field VA while the pattern PP is scanned in the scanning direction DD. Thus, a discharge state of droplets can be examined without detail reading of the dots DT in the pattern PP printed by the discharging head 30 by an imaging element with a high resolution or the like. Such imaging element with a high resolution is not required to be used, and hence the configuration of the detecting device 10 can be simplified. Further, through use of the optical sensor 60 with a low resolution, a manufacturing cost for the detecting device 10 can be reduced. Specifically, the light-receiving unit 43 may be formed of an optical sensor with a lower resolution than the printing resolution of the discharging head 30.

In the light-receiving unit 43 included in the detecting device 10 according to First Exemplary Embodiment, the opening 53 defines the visual field VA in which the predetermined number of dots DT included in the pattern PP are included. A read range for the light-receiving unit 43 is defined appropriately for the pattern PP. Thus, the detection of the pattern PP through scanning by the light-receiving unit 43 is facilitated, and a detection accuracy of a discharge state of droplets is improved. In the detecting device 10 according to First Exemplary Embodiment, the opening 53 is formed as a through hole in the mask member 52 attached to the path for taking in the reflected light RL. For example, a size of the opening 53 can easily be changed by replacing the mask member 52, and thus the visual field VA of the light-receiving unit 43 can easily be defined.

With the detecting device 10 according to First Exemplary Embodiment, through use of the period of the intensity change of the reflected light RL at the time of scanning the pattern PP including the dot row DR in which the dots DT are arranged in the crossing direction CD, it can easily be detected that landing positions of droplets are shifted in the scanning direction DD. Further, through use of a magnitude of the intensity of the reflected light RL at the time of scanning the pattern PP including the overlapping dot row DRo in which the dots DT partially overlap with each other in the crossing direction CD, it can easily be detected that landing positions of droplets are shifted in the crossing direction CD.

With the droplet discharging device 100 according to First Exemplary Embodiment, the detecting device 10 scans the pattern PP formed by the discharging head 30. Accordingly, a discharge state of droplets from the discharging head 30 can easily be examined. In addition, with the detecting device 10 and the droplet discharging device 100 according to First Exemplary Embodiment, the various effects described in First Exemplary Embodiment can be achieved.

2. Second Exemplary Embodiment

Figure 7:
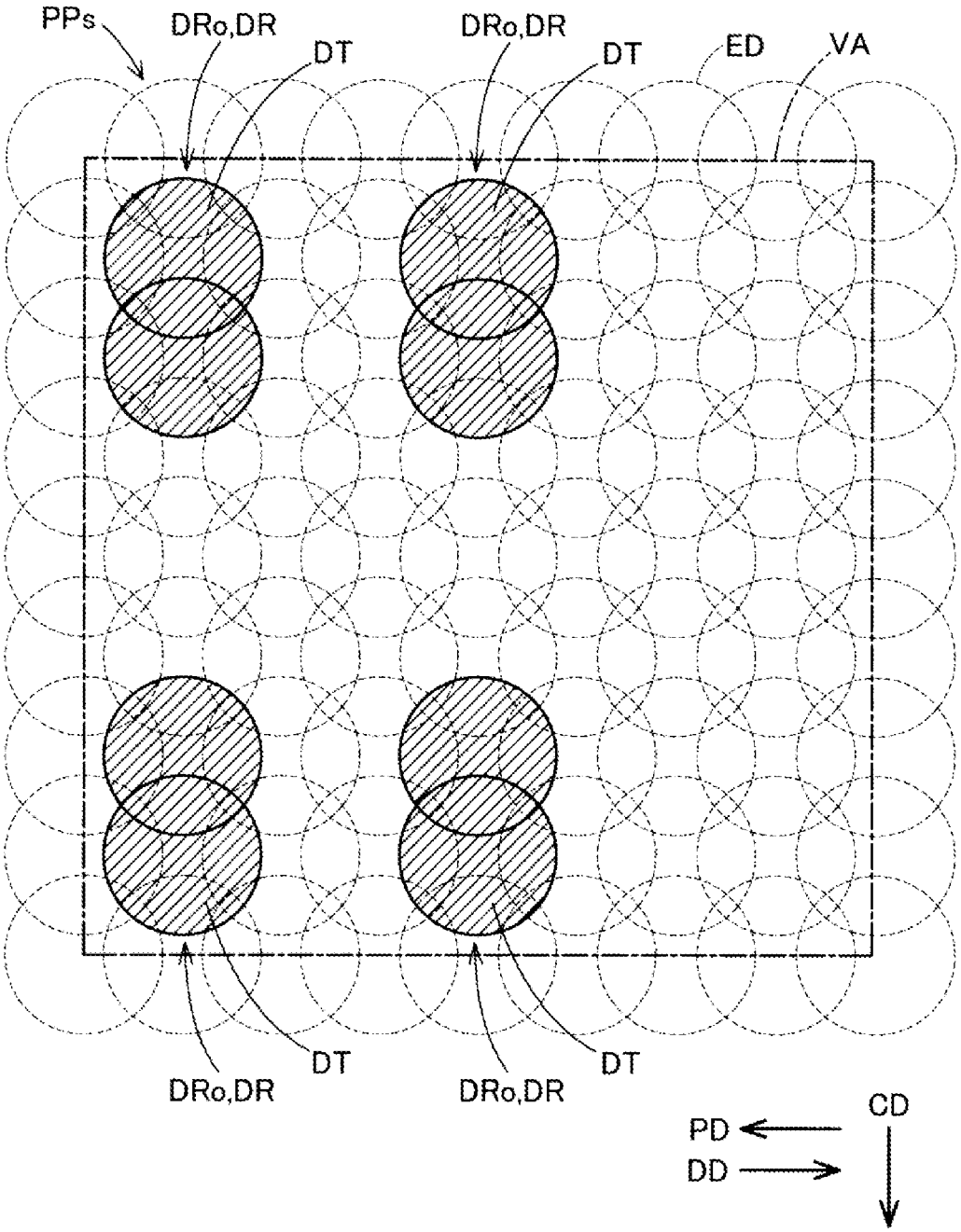
FIG. 7 is a schematic view illustrating an example of a pattern in Second Exemplary Embodiment of the invention.
Figure 8:
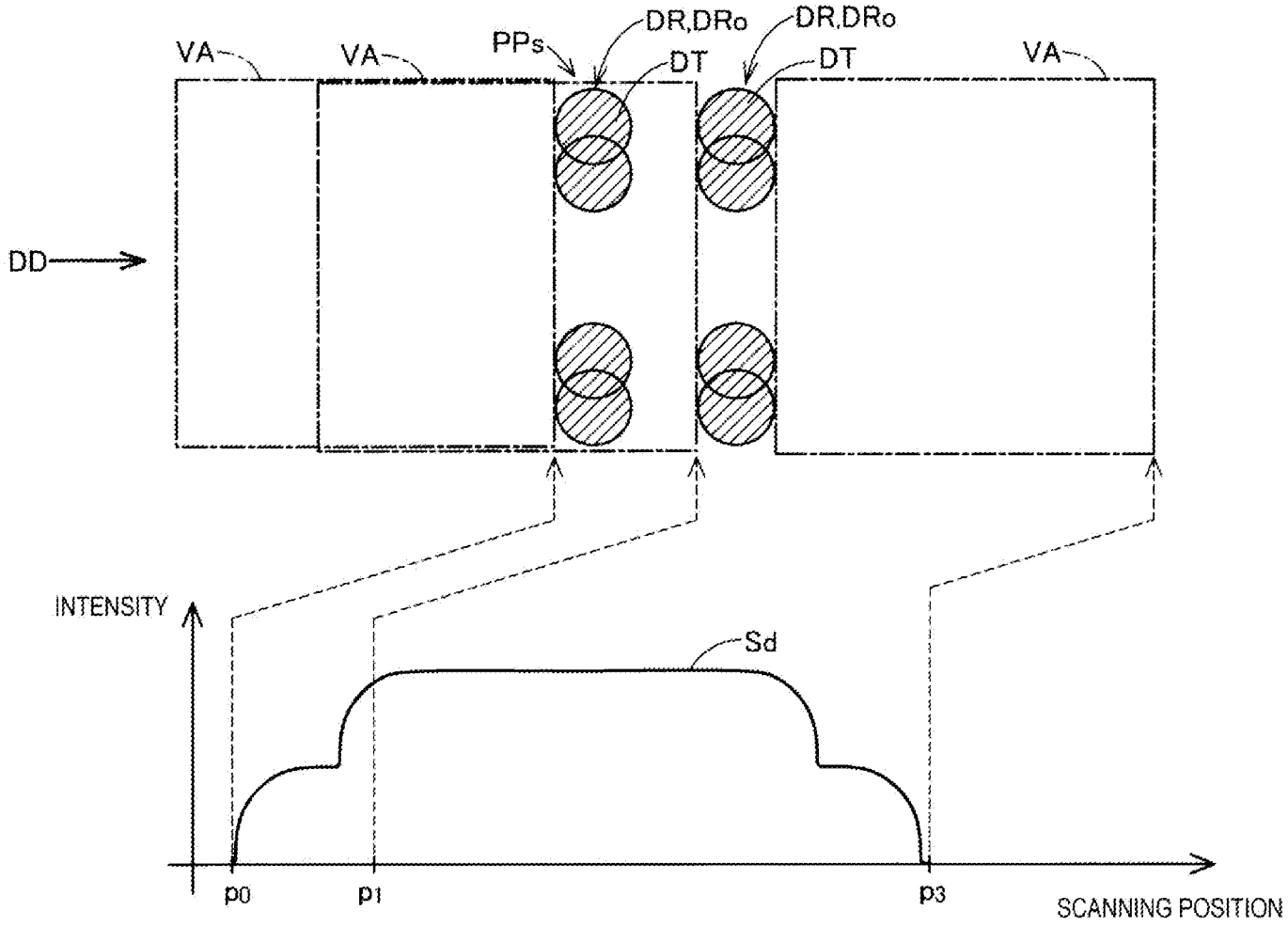
FIG. 8 is a schematic view illustrating an example of a scanning result of the pattern in Second Exemplary Embodiment.

With reference to FIG. 7 and FIG. 8, the pattern PP in Second Exemplary Embodiment is described. FIG. 7 is a schematic view illustrating an example of a pattern PPs in Second Exemplary Embodiment. A droplet discharging device and a detecting device according to Second Exemplary Embodiment have substantially the same configurations described in First Exemplary Embodiment except for the point in which a size of the visual field VA is changed according to the pattern PPs. Further, the control unit 11 performs the inspection process with the similar flow described in First Exemplary Embodiment (FIG. 4).

In Second Exemplary Embodiment, the nozzle row 32*r* is formed of five or more nozzles 32. In Second Exemplary Embodiment, the control unit 11 selects two pairs of adjacent nozzles $\mathbf{32}_n$ and $\mathbf{32}_{n+1}$ and adjacent nozzles $\mathbf{32}_{n+m}$ and $\mathbf{32}_{n+m+1}$ (FIG. 2) as inspection targets in the nozzle row 32*r*. "m" in a symbol is an arbitrary natural number equal to or larger than three. Thus, the pattern PPs in Second Exemplary Embodiment includes four overlapping dot rows DRo. Note that, the opening 53 of the light-receiving unit 43 has an opening width larger than the opening width in First Exemplary Embodiment so that the four overlapping dot rows DRo are included in the visual field VA. Further, in the light-receiving unit 43, a size of the light-receiving surface of the optical sensor 60 and a size of the optical fiber 54 are larger than the sizes in the configuration of First Exemplary Embodiment, according to an area of the visual field VA.

FIG. 8 is a schematic view illustrating an example of a scanning result of the pattern PPs in Second Exemplary Embodiment. In the example in FIG. 8, scanning of the pattern PPs is started at the position p0, and scanning of a second pair of the overlapping dot rows DRo in the pattern PPs is started at the position p1. Further, scanning of the pattern PPs is completed at a position p3.

In the pattern PPs in Second Exemplary Embodiment, as with the pattern PP in First Exemplary Embodiment, the light-receiving signal Sd, in which the intensity of the reflected light RL is changed in a stepwise manner at timings when the overlapping dot rows DRo enter the visual field VA and move out from the visual field VA, can be obtained. Therefore, with the same determination process described in First Exemplary Embodiment, discharge states of droplets from the target nozzles $\mathbf{32}_n$ and $\mathbf{32}_{n+1}$ and target nozzles $\mathbf{32}_{n+m}$ and $\mathbf{32}_{n+m+1}$ to be inspected can be examined. Note that, with Second Exemplary Embodiment, the four nozzles 32 can be examined by performing the determination process once, which is efficient. In addition, with the detecting device and the droplet discharging device including the detecting device according to Second Exemplary Embodiment, the various effects described in First Exemplary Embodiment described above can be achieved.

3. Third Exemplary Embodiment

Figure 9:
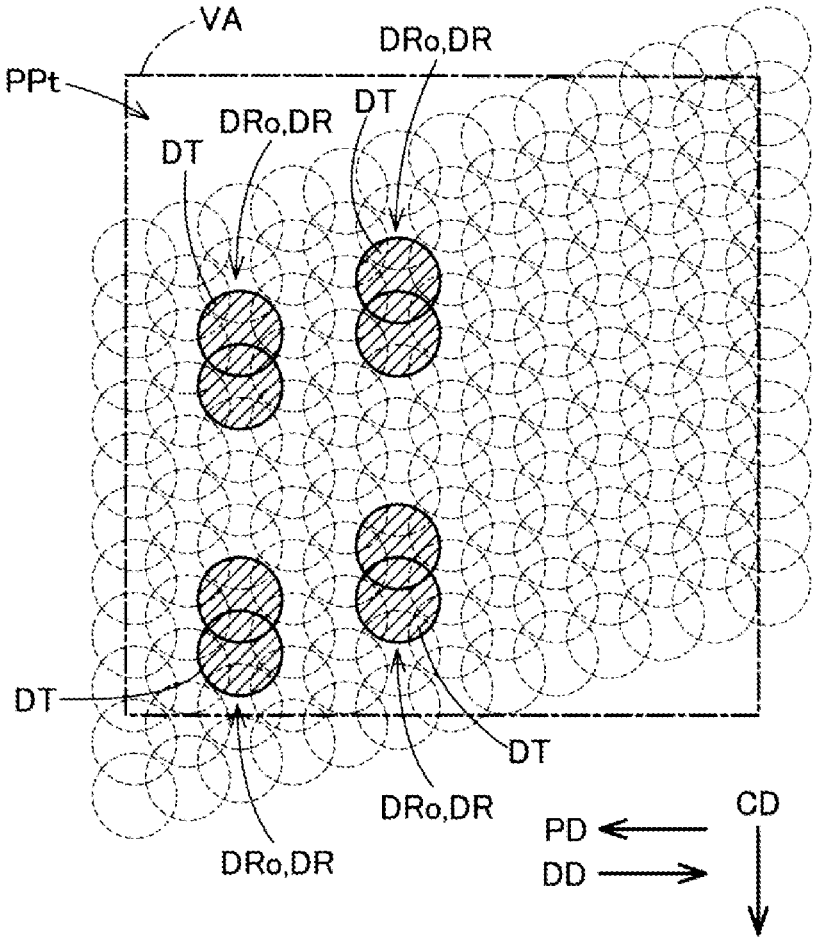
FIG. 9 is a schematic view illustrating an example of a pattern in Third Exemplary Embodiment.

FIG. 9 is a schematic view illustrating an example of a pattern PPt in Third Exemplary Embodiment. A droplet discharging device and a detecting device according to Third Exemplary Embodiment have substantially the same configurations of the droplet discharging device and the detecting device according to Second Exemplary Embodiment. Further, the control unit 11 performs the inspection process with the similar flow described in First Exemplary Embodiment (FIG. 4) except for the control method of the discharging head 30 in the pattern formation process.

In the pattern formation process in Step S10, the control unit 11 causes the medium MD to be transported in the transport direction PD at a constant transport speed, causes the discharging head 30 to move in the moving direction MS (FIG. 2), and causes the target nozzles $\mathbf{32}_n$ and $\mathbf{32}_{n+1}$ and target nozzles $\mathbf{32}_{n+m}$ and $\mathbf{32}_{n+m+1}$ to be inspected to discharge droplets. With this operation, the pattern PPt in which the overlapping dot rows DRo are arranged in a direction obliquely crossing the transport direction PD is formed. Even in a case where the overlapping dot rows DRo are arranged obliquely with respect to the scanning direction DD, the light-receiving signal Sd similar to the signal described in Second Exemplary Embodiment can be obtained (FIG. 8). Thus, as in Second Exemplary Embodiment, a discharge state of droplets can easily be examined.

In the droplet discharging device according to Third Exemplary Embodiment, the discharging head 30 is caused to perform the pattern formation process, and on a downstream with respect to the discharging head 30, the pattern detection unit 40 scans the pattern PPt to perform the determination process. As described above, in the droplet discharging device according to Third Exemplary Embodiment, while the medium MD is transported at a constant speed, the pattern formation process and the determination process are performed in parallel, which is efficient. In addition, with the detecting device and the droplet discharging device including the detecting device according to Third Exemplary Embodiment, the various effects, which are similar to the effects achieved by the detecting device and the droplet discharging device including the detecting device according to Second Exemplary Embodiment, can be achieved.

4. Fourth Exemplary Embodiment

Figure 10:
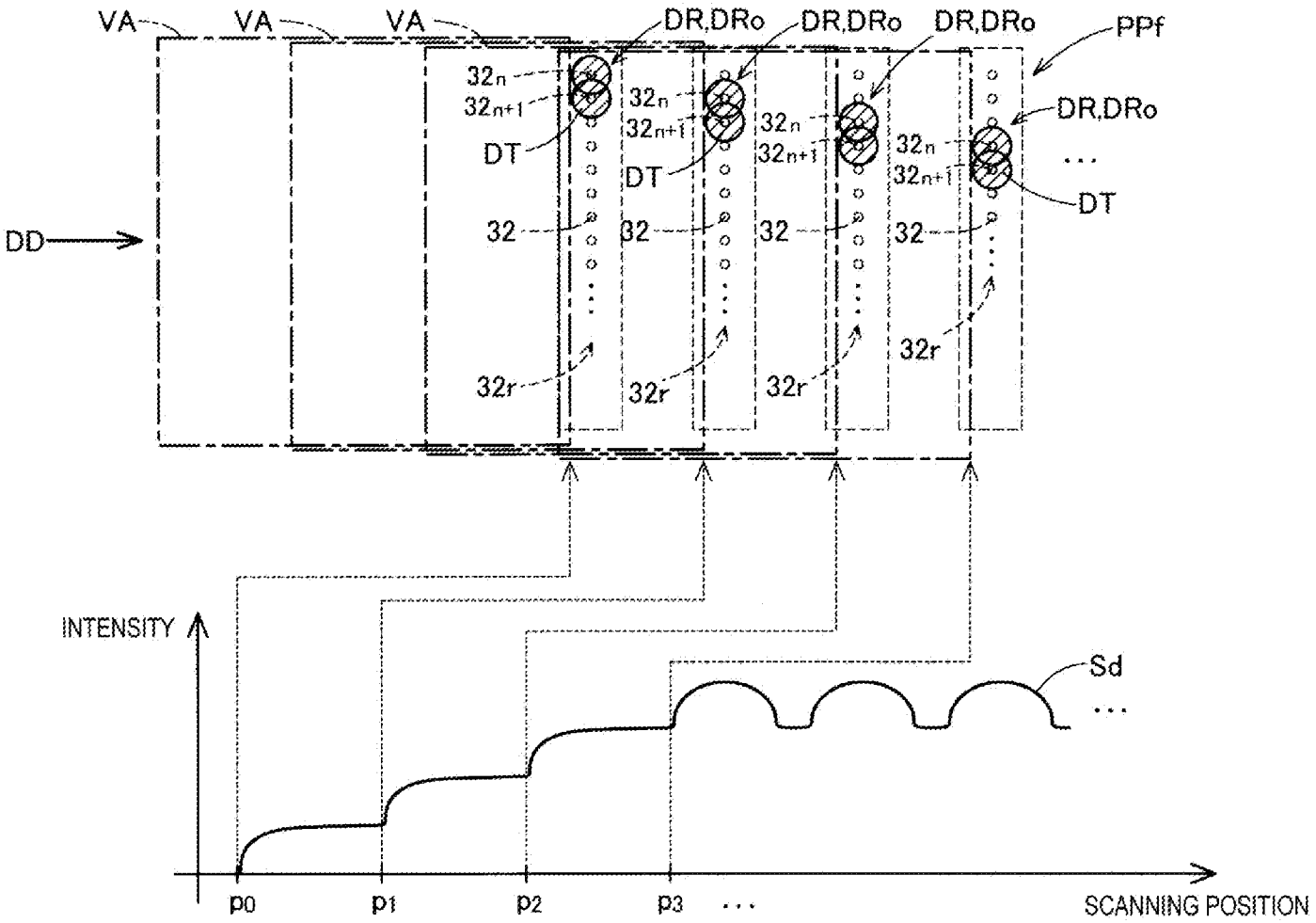
FIG. 10 is a schematic view for illustrating an example of control for forming a pattern and a scanning result of the pattern in Fourth Exemplary Embodiment.

FIG. 10 is a schematic view for illustrating an example of control for forming a pattern PPf and a scanning result of the pattern PPf in Fourth Exemplary Embodiment. A droplet discharging device and a detecting device according to Fourth Exemplary Embodiment have substantially the same configurations of the droplet discharging device 100 and the detecting device 10 according to First Exemplary Embodiment. Further, the control unit 11 performs the inspection process with the similar flow described in First Exemplary Embodiment (FIG. 4) except for the control method of the discharging head 30 in the pattern formation process.

In the droplet discharging device according to Fourth Exemplary Embodiment, in the pattern formation process in Step S10, the control unit 11 performs an increment process in which n is incremented by 1 (n=n+1) for each time when one overlapping dot row DRo is formed, to thereby shift the order of the nozzles 32 to be the target nozzles $\mathbf{32}_n$ and $\mathbf{32}_{n+1}$ to be inspected one by one. Further, after the medium MD is transported in the transport direction PD by a predetermined distance, a next overlapping dot row DRo is formed by new target nozzles $\mathbf{32}_n$ and $\mathbf{32}_{n+1}$ to be inspected. The control unit 11 changes the target nozzles $\mathbf{32}_n$ and $\mathbf{32}_{n+1}$ to be inspected so that the overlapping dot row DRo repeatedly appears along the scanning direction DD for a period in accordance with the transport speed of the medium MD, and a plurality of overlapping dot rows DRo are sequentially formed.

When the pattern PPf formed in the pattern formation process is scanned in the scanning direction DD by the light-receiving unit 43, the light-receiving signal Sd can be obtained. In the light-receiving signal Sd, a change of the intensity of the reflected light RL, which rises in a convex shape, repeatedly appears for each time when the overlapping dot row DRo newly enters the visual field VA (at the positions p0, p1, p2, p3 . . . ). Even with the light-receiving signal Sd, by the similar method described in First Exemplary Embodiment, it can be detected that landing positions of droplets are shifted. With the droplet discharging device according to Fourth Exemplary Embodiment, the nozzles 32 forming the nozzle row 32*r* can be inspected for a shorter time period. In addition, with the detecting device and the droplet discharging device including the detecting device according to Fourth Exemplary Embodiment, the various effects, which are similar to the effects achieved by the detecting device and the droplet discharging device including the detecting device according to First Exemplary Embodiment, can be achieved.

5. Other Exemplary Embodiments

The various configurations described in the above-mentioned exemplary embodiments can be modified as describe below, for example. Any of other exemplary embodiments described below is regarded as an example for carrying out the invention similarly to the above-mentioned exemplary embodiments.

5-1. Other Exemplary Embodiment 1

In the above-mentioned exemplary embodiments, the detecting device 10 is incorporated in the droplet discharging device 100 together with the discharging head 30. Meanwhile, the detecting device 10 may not be incorporated in the droplet discharging device 100, and may be an independent device. In this case, for example, after the pattern PP is recorded on the medium MD by the discharging head 30, a user may set the medium MD for the detecting device 10 to cause the scanning of the pattern PP to be performed.

5-2. Other Exemplary Embodiment 2

The pattern structures to be scanned by the detecting device 10 are not limited to the patterns PP, PPs, PPt, and PPf described in the above-mentioned exemplary embodiments. The pattern structures to be scanned by the detecting device 10 may include, for example, a structure including the dot row DR in which adjacent dots DT do not overlap with each other. Further, the crossing direction CD in which the dots DT are arranged in the dot row DR may be a direction obliquely crossing the scanning direction DD. The dots DT forming the dot row DR may not be recorded by the nozzles $\mathbf{32}_n$ and $\mathbf{32}_{n+1}$ adjacent to each other. Even in this case, as described with reference to FIG. 6C, when the dots DT forming the dot row DR are shifted from each other, the period of the light-receiving signal Sd is changed. Accordingly, it can be detected that landing positions of droplets are shifted in the scanning direction DD. Further, the pattern structures scanned by the detecting device 10 may not include the dot row DR, and may be formed of one dot DT.

Even in this case, based on a change of the area of the dot DT, a discharge amount of a droplet can be examined.

5-3. Other Exemplary Embodiment 3

In the above-mentioned exemplary embodiments, the opening shape of the opening 53 may not be rectangular. The opening 53 may be formed of, for example, a circular shape, or may have an opening shape with a partial side formed of a curved line. Note that, it is desired that the opening 53 includes a part with an opening width from twice to twenty times as large as a diameter of dots forming a target pattern to be scanned. The opening 53 may be formed of, for example, a single or a plurality of slits. A longitudinal direction of the slit(s) is not particularly limited, and may be parallel to the scanning direction DD or a direction crossing the scanning direction DD. The opening 53 may not be a through hole in the mask member 52. The opening 53 may be formed of a shape of the inner wall surface of the light inlet 51.

5-4. Other Exemplary Embodiment 4

The patterns to be scanned by the detecting device 10 may include, for example, a solid pattern in which the dots DT fill up a certain area. In this case, a discharge state of droplets from the discharging head 30 may be determined by detecting, for example, a ripple caused in the light-receiving signal Sd by a dot blank and a shake caused in the light-receiving signal Sd by density unevenness of a solid pattern.

5-5. Other Exemplary Embodiment 5

In a case where the discharging head 30 includes the plurality of nozzle rows 32*r* in which positions of nozzles 32 at the same order overlap with each other in the transport direction PD, a pattern may be formed with dots by overlapping droplets from the nozzles 32 at the same order in the plurality of nozzle rows 32*r*. Even with this configuration, when an error is caused in landing positions or discharge amounts of the droplets for forming dots to be overlapped with each other, an area of the dots in the pattern is changed. Accordingly, such defect of the discharge state can be detected as a shift of the light-receiving signal Sd from the reference data RD. Note that, the discharging head 30 may be supported by the rails 31 so that the nozzles 32 in the nozzle row 32*r* are arranged along the transport direction PD. Also in this case, a relative move between the discharging head 30 and the medium MD is controlled. Accordingly, the formation of the pattern PP can be read, and hence the invention can be carried out.

5-6. Other Exemplary Embodiment 6

In the detecting device 10, the opening 53 may be formed of a single thin slit, and the control unit 11 may perform the determination process by using a signal obtained by performing Fast Fourier Transform (FFT) on the light-receiving signal Sd output from the light-receiving circuit 65. In this case, the control unit 11 may form a pattern so that the discharging head 30 forms a curved line obtained by binarizing Sin (a·t) and changing a value of a variable a for each nozzle 32.

5-7. Other Exemplary Embodiment 7

The discharging head for which a discharge state of droplets is detected by the detecting device 10 may not be a discharging head of a printer for discharging droplets of ink. The detecting device 10 may be mounted to a droplet discharging device other than a printer. The detecting device 10 may be configured, for example, for detecting a discharge state of droplets from a discharging head configured to discharge droplets of various liquids such as adhesive and detergent. The detecting device 10 may be mounted to a droplet discharging device including such discharging head.

5-8. Other Exemplary Embodiment 8

In the above-mentioned exemplary embodiments, a part of or all of the functions and the processes implemented by software may be implemented by hardware. Furthermore, a part of or all of the functions and the processes implemented by hardware may be implemented by software. The hardware may be, for example, any of various circuits such as an integrated circuit, a discrete circuit, and a circuit module with a combination of integrated circuits or discrete circuits.

The invention is not limited to the above-mentioned exemplary embodiments (including other exemplary embodiments). Rather, the invention can be achieved in various configurations, to an extent that such configurations fall within the scope of the invention. For example, technical features of the exemplary embodiments and examples, which correspond to the technical features of the embodiments described in the summary of the invention, may be appropriately replaced or combined to address some or all of the above-identified problems or to achieve some or all of the above-described advantages. Further, as long as the technical matters, which are not limited to the matters described as optional in the description, are not described as essential in the description, such matters can appropriately be eliminated.

This application claims priority under 35 U.S.C. § 119 to Japanese Patent Application No. 2018-003018, filed Jan. 12, 2018. The entire disclosure of Japanese Patent Application No. 2018-003018 is hereby incorporated herein by reference.

What is claimed is:

1. A detecting device for detecting a discharge state of droplets from a discharging head configured to discharge the droplets onto a medium, the detecting device comprising:

an irradiation unit configured to irradiate the medium on which a predetermined pattern is recorded with the droplets with irradiation light, and to scan the medium with the irradiation light in a scanning direction;

a light-receiving unit configured to receive reflected light which is the irradiation light reflected by the medium, and to output a signal indicating intensity of the reflected light; and a control unit configured to perform determination process for determining the discharge state of the droplets onto the medium by using intensity change of the reflected light in scanning the predetermined pattern in the scanning direction, wherein the light-receiving unit includes an optical sensor having a lower resolution than a printing resolution of the discharging head.

2. The detecting device according to claim 1, wherein the opening includes a part with a width from twice to twenty times as large as a diameter of the dots.

3. The detecting device according to claim 1, wherein the predetermined pattern includes at least a dot row being a dot pattern in which a plurality of dots are arranged, and the control unit is configured to detect whether landing positions of the droplets are shifted in the scanning direction by using a period of intensity change of the reflected light which is obtained by scanning the dot row in the scanning direction.

4. The detecting device according to claim 1, wherein the predetermined pattern includes an overlapping dot row being a dot pattern in which a plurality of dots are arranged in a partially overlapping state, and the control unit is configured to detect whether landing positions of the droplets are shifted by using intensity of the reflected light which is obtained by scanning the overlapping dot row in the scanning direction.

5. The detecting device according to claim 1, wherein the light-receiving unit includes the opening and a mask member to be attached to a path for taking in the reflected light.

6. A droplet discharging device comprising:

a discharging head configured to discharge droplets onto a medium; and the detecting device according to claim 1.

7. The droplet discharging device according to claim 6, further comprising:

a transport path configured to transport the medium, wherein the discharging head is configured to move in a moving direction orthogonal to a transport direction of the medium on the transport path, the irradiation unit and the light-receiving unit are positioned on a downstream side with respect to the discharging head on the transport path, and a pattern formation process for forming the predetermined pattern on the medium is performed, the predetermined pattern in which dot patterns with a plurality of dots are arranged in a direction orthogonal to the transport direction being arranged in a direction obliquely crossing the transport direction, the predetermined pattern being formed by the discharging head moving in the moving direction and discharging the droplets while the medium is transported on the transport path in the transport direction, and the determination process is performed by scanning the predetermined pattern in a direction opposite to the transport direction as the scanning direction.

8. A detecting method for detecting a discharge state of droplets from a discharging head configured to discharge the droplets onto a medium, the detecting method comprising:

scanning a predetermined pattern which is recorded on the medium with the droplets discharged from the discharging head with irradiation light in a scanning direction;

receiving reflected light using a light-receiving unit that includes an optical sensor having a lower resolution than a printing resolution of the discharging head, wherein the reflected light is the irradiation light reflected by the medium, and acquiring a signal indicating intensity change of the reflected light; and determining the discharge state of the droplets onto the medium by using the signal.

* * * * *